US008191685B1

(12) United States Patent
Geiselman, III

(10) Patent No.: US 8,191,685 B1
(45) Date of Patent: Jun. 5, 2012

(54) FOLDING LADDER

(76) Inventor: Grover J. Geiselman, III, Richmond, TX (US)

( * ) Notice: Subject to any disclaimer, the term of this patent is extended or adjusted under 35 U.S.C. 154(b) by 0 days.

(21) Appl. No.: 13/108,474

(22) Filed: May 16, 2011

(51) Int. Cl.
*E06C 1/00* (2006.01)

(52) U.S. Cl. ..... 182/165; 182/156; 182/159; 182/170; 182/177

(58) Field of Classification Search ..... 182/156, 182/159, 165, 170, 171, 177
See application file for complete search history.

(56) References Cited

U.S. PATENT DOCUMENTS

| | | | | | |
|---|---|---|---|---|---|
| 314,899 | A * | 3/1885 | Wilson | 182/160 |
| 382,114 | A * | 5/1888 | Sherman | 182/159 |
| 2,347,065 | A * | 4/1944 | Rigby | 182/177 |
| 2,368,915 | A * | 2/1945 | Brandel | 182/177 |
| 2,580,045 | A * | 12/1951 | Reed | 182/170 |
| 2,650,014 | A * | 8/1953 | Harrison | 182/170 |
| 3,005,513 | A * | 10/1961 | Larson | 182/165 |
| 3,043,397 | A * | 7/1962 | Tillotson | 182/124 |
| 3,057,432 | A * | 10/1962 | Harrison | 182/156 |
| 3,446,311 | A * | 5/1969 | Alfie | 182/156 |
| 3,722,622 | A * | 3/1973 | Lauring | 182/159 |
| 3,756,347 | A * | 9/1973 | Messera et al. | 182/95 |
| 4,678,060 | A * | 7/1987 | Pugliese | 182/160 |
| 4,796,727 | A * | 1/1989 | Eaton | 182/168 |
| 4,998,982 | A * | 3/1991 | Arnold et al. | 182/159 |
| 5,195,610 | A * | 3/1993 | Chang | 182/156 |
| 6,145,621 | A * | 11/2000 | Nye | 182/159 |
| 6,769,515 | B2 * | 8/2004 | Hillebrecht et al. | 182/159 |
| 6,802,393 | B2 * | 10/2004 | Zheng | 182/159 |
| 6,866,119 | B2 * | 3/2005 | Zheng | 182/172 |
| 6,874,598 | B1 * | 4/2005 | Baker | 182/165 |
| 2002/0112920 | A1 * | 8/2002 | Price | 182/159 |
| 2003/0234140 | A1 * | 12/2003 | Zheng | 182/159 |
| 2006/0032708 | A1 * | 2/2006 | Welsh | 182/159 |
| 2009/0229918 | A1 * | 9/2009 | Moss et al. | 182/129 |

* cited by examiner

*Primary Examiner* — Alvin Chin Shue
*Assistant Examiner* — Colleen M Chavchavadze
(74) *Attorney, Agent, or Firm* — Buskop Law Group, PC; Wendy Buskop

(57) ABSTRACT

A folding ladder with a pair of parallel front support members having a plurality of sequentially positioned grooves, a plurality of front aligned fastener holes aligned with a plurality of back fastener holes, a pair of non-parallel back support members, wherein the back support member inside forms a flush engagement with the front support member outer side; a plurality of pivot means disposed centrally through each back top end and extending from each back top end to an off center position in each front support top end, a plurality of pivoting non-removable rungs, a pair of locking spreader bars, a pair of pivotable cross braces and a plurality of recessed magnets for supporting the pivoting cross braces and for allowing portions of the folding ladder to compactly and securely engage each other.

8 Claims, 6 Drawing Sheets

FIGURE 5A
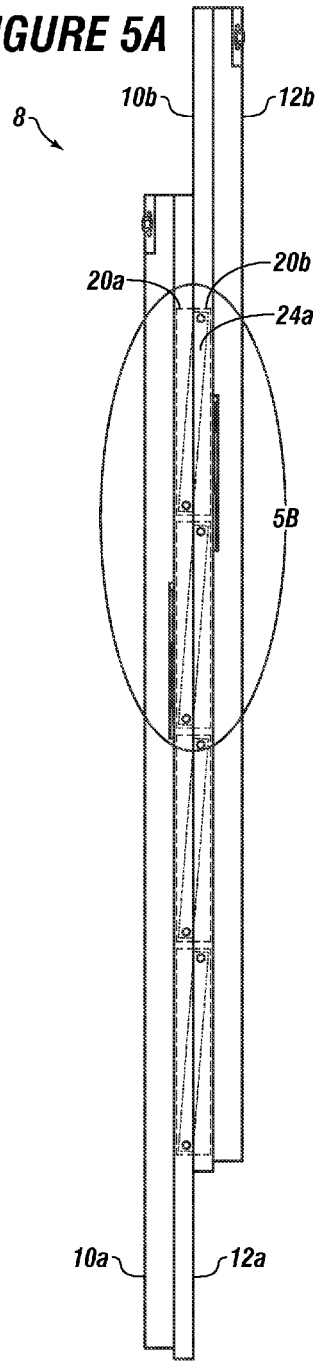
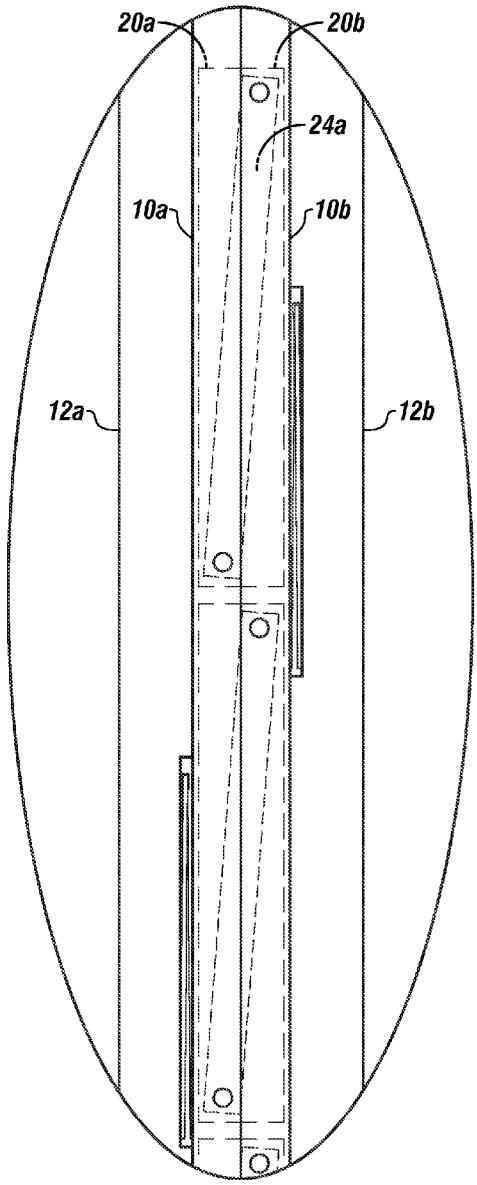
FIGURE 5B

FOLDING LADDER

FIELD

The present embodiments generally relate to a folding ladder.

BACKGROUND

A need exists for a folding ladder that is lightweight and small.

A further need exists for a ladder that can be transported in a vehicle without taking up to much space.

The present embodiments meet these needs.

BRIEF DESCRIPTION OF THE DRAWINGS

The detailed description will be better understood in conjunction with the accompanying drawings as follows:

FIG. 5A depicts an assembled view of the folding ladder of FIG. 1 in a folded configuration according to one or more embodiments.

FIG. 5B depicts a detailed view of a portion of the folding ladder of FIG. 1 in a folded configuration according to one or more embodiments.

Figure 1:
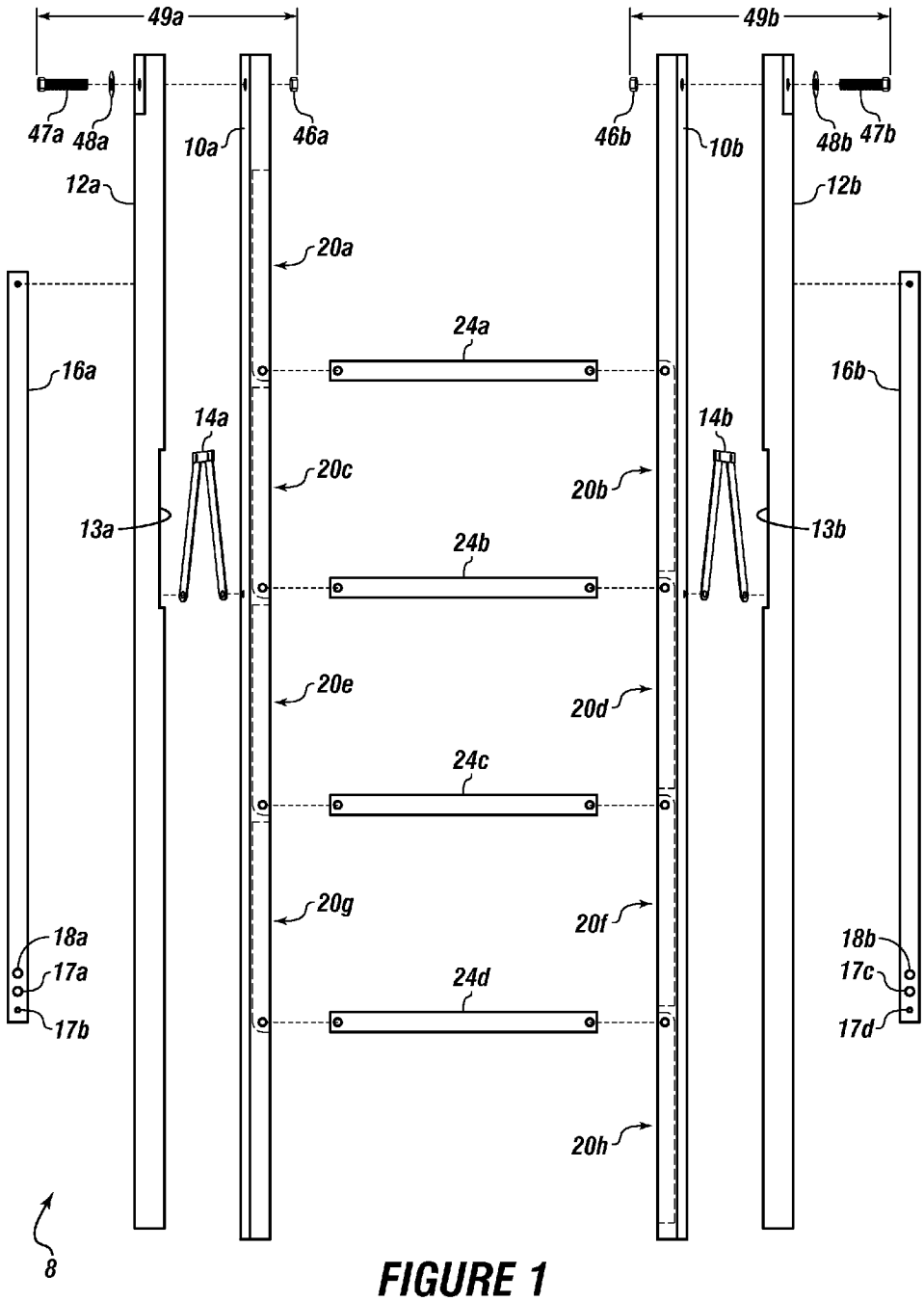
FIG. 1 depicts an exploded view of a folding ladder according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a folding ladder.

The folding ladder can have a small footprint when in a collapsed position.

The folding ladder can have a pair of parallel front support members with a plurality of sequentially positioned grooves.

A plurality of front fastener holes can be formed through the parallel front support members for securing non-removable rungs within the sequentially positioned grooves. A plurality of back fastener holes can be formed in the parallel front support members and aligned with the front fastener holes.

The folding ladder can have a pair of locking spreader bars. The locking spreader bars can be used to lock the back support members and front support members in a deployed position.

A pair of pivotable cross braces can be used to support the back support members.

The folding ladder can also have a pair of non-parallel back support members. The non-parallel back support members can be configured to form a flush engagement with the front support member outer side when in a folded configuration.

The back support members can be connected to the front support members by a plurality of pivots means. Each pivot means can be located at least partially through an associated back top end and an associated front support top end. The pivot means can be centered in the back top end and off center in the front support top end. The pivot means can be a rivet, a pin, or other mechanical fastener that allows rotation.

A plurality of recessed magnets can be used to support the pivoting cross braces and can allow portions of the folding ladder to compactly and securely engage each other.

The folding ladder can be made from any material. For example, the folding ladder can be made from composite material, natural materials, aluminum, or the like.

The front support members and back support members can have hard rubber bases or footings.

In one or more embodiments, a small latch can be used to secure the front support member to the back support member. The latch can be any locking means. For example, a first portion of the latch can be a hook disposed on one of the front support members or the back support members, and a protrusion disposed on the other support member.

A carrying handle can be placed on a portion of ladder. For example, the carrying handle can be connected to a middle portion of the ladder, such as a middle portion of one of the support members.

The front support members, back support members, or both can have indentions in a portion thereof configured to conceal or accommodate the lock spreader bars.

In one or more embodiments the folding ladder can include a pair of front support members. Each front support member can have a top end and a bottom end. The front support members can be parallel to one another.

The front support members can include an inside side. A front side can be connected to the inside at about 90 degree angle. The front side can have an outer side extending therefrom at about a 95 degree angle to about a 120 degree angle. The inside side can have a back side connected thereto at about a 90 degree angle. The front support members can include a plurality of grooves on the inside side thereof. The front support members have identical lengths. The front support members can range in length from about 2 feet to about 24 feet.

The grooves can include a groove bottom end, and a groove top end. The grooves can be formed on the inside side of the front support members. The groove bottom ends of the first front support member can be horizontally aligned with the groove top ends of the second front support member.

The front support members can also include a plurality of front fastener holes can be disposed in the front side aligned with a plurality of back fastener holes in the back side.

The folding ladder can include a pair of back support members. The back support members can have a back top end and a back bottom end. The back support members can be non-parallel to one another. The back support members can be spaced apart in an increasing distance along the length of the back support member.

The back support members can include a back support member front side; a back support member inside with a channel; a back support member outer side; and a back support member back side, wherein the back support member inside forms a flush engagement with the front support member outer side. The back support members can have identical lengths.

The folding ladder can also include a plurality of pivot means. The pivot means can be disposed centrally through each back top end and extend from each back top end to an off center position in each front support top end.

The folding ladder can also include a plurality of rungs. The rungs can be rotatably supported between the front support members with a pair of fasteners. The rungs can pivotably connect the groove bottom end of one the first support member grooves with adjacent top ends of the grooves of the second front support member. The rungs can rest at least partially within the grooves when the folding ladder is in a folded position. For example, the rungs can fold into the sequentially positioned grooves of at least one of the front support members.

The folding ladder can also include a pair of locking spreader bars. The locking spreader bars can foldably engage a front support member to a back support member.

The folding ladder can also include a pair of pivotable cross braces. Each pivotable cross brace can have a first brace end secured to the back support member outer side proximate to the back top end, and a second brace end secured to the back support member towards the back bottom end. The cross braces can form an X proximate to a midpoint between the back support members.

The folding ladder can also include a plurality of recessed magnets for supporting the pivoting cross braces and for allowing portions of the folding ladder to compactly and securely engage each other Turning now to Figures, FIG. 1 depicts an exploded view of a folding ladder 8 according to one or more embodiments.

The folding ladder 8 can include a first front support member 10*a* and a second front support member 10*b*. A first pivot means 49*a* can connect the first front support member 10*a* to a first back support member 12*a* and a second pivot means 49*b* can connect the second front support member 10*b* to a second back support member 12*b*.

The first pivot means 49*a* can include a first connector 47*a*, which can be a pin or another fastener capable of supporting a moment, a first washer 48*a*, and a first nut 46*a*. The second pivot means 49*b* can include a second connector 47*b*, a second washer 48*b*, and a second nut 46*b*. The pivot means are described in more detail below in FIGS. 2A and 2B.

The front support members 10*a* and 10*b* can include a plurality of grooves, such as grooves 20*a*, 20*b*, 20*c*, 20*d*, 20*e*, 20*f*, 20*g*, and 20*h*. The front support members are described in more detail below in FIGS. 3A and 3B.

A plurality of rungs, such as rungs 24*a*, 24*b*, 24*c*, and 24*d*, can be at least partially disposed within the plurality of grooves 20*a*, 20*b*, 20*c*, 20*d*, 20*e*, 20*f*, 20*g*, and 20*h*. For example, a first rung 24*a* can be connected to a first groove 20*a* and a second groove 20*b*, a second rung 24*b* can be connected to a third groove 20*c* and a fourth groove 20*d*, a third rung 24*c* can be connected to a fifth groove 20*e* and a sixth groove 20*f*; a fourth 24*d* can be connected within a seventh groove 20*g* and an eight groove 20*h*. The rungs can pivot within the grooves. The rungs can have a flattened top side forming a step.

The insides of the back support members 12*a* and 12*b* can have a channel 13*a* and 13*b*.

A first locking spreader bar 14*a* can be connected to the first front support member 10*a* and to the first back support member 12*a*. The first locking spreader bar 14*a* can be connected to the first back support member 12*a* adjacent or within the first channel 13*a*.

A second locking spreader bar 14*b* can be connected to the second front support member 10*b* and to the second back support member 12*b*. The second locking spreader bar 14*b* can be connected to the second back support member 12*b* adjacent or within the second channel 13*b*.

A first pivotable cross brace 16*a* can be connected to a portion of the first back support member 12*a*, and a second pivotable cross brace 16*b* can be connected to a portion of the second back support member 12*b*. The pivotable cross braces 16*a* and 16*b* can have one or more brace positioning magnets, such as magnets 17*a*, 17*b*, 17*c*, and 17*d*. The pivotable cross braces 16*a* and 16*b* can have one or more cavities, such as cavities 18*a* and 18*b*, for receiving one or more locking pins on the back support members 12*a* and 12*b*.

Figure 2B:
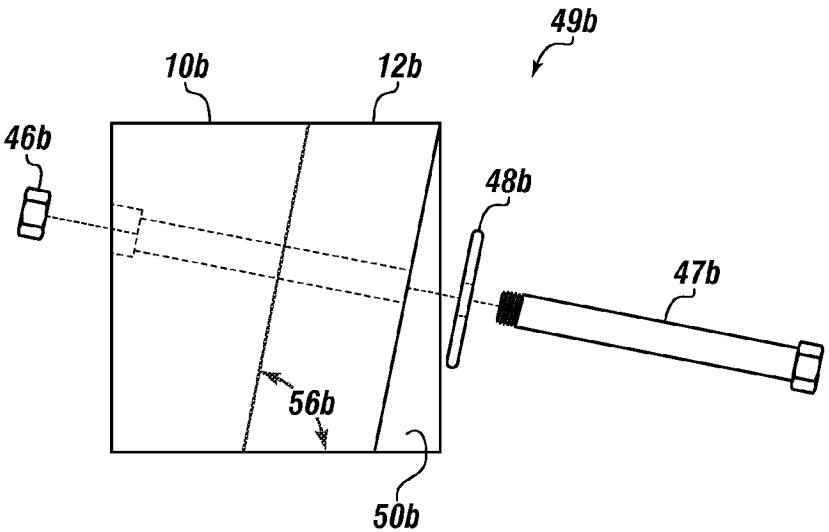
FIG. 2B depicts the second pivot means according to one or more embodiments.
Figure 2A:
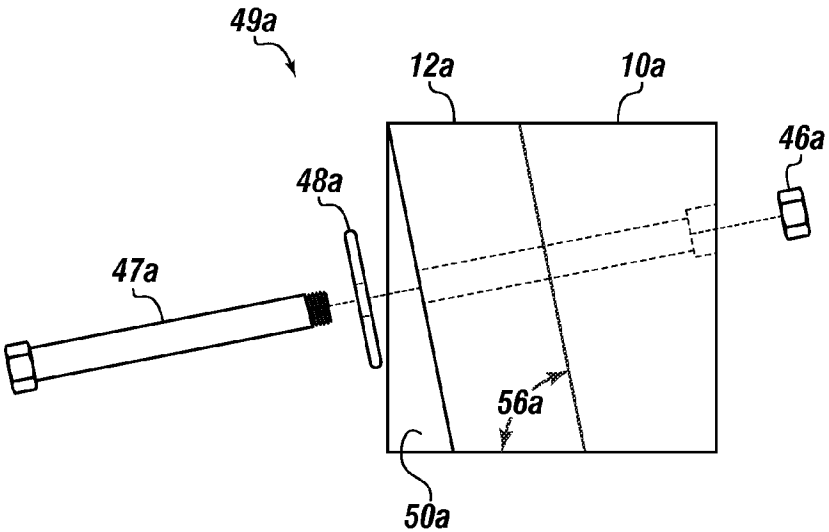
FIG. 2A depicts the first pivot means according to one or more embodiments.

FIG. 2A depicts the first pivot means 49*a* according to one or more embodiments.

The first connector 47*a* can pass through the first back support member 12*a*, such that the first connector 47*a* is perpendicular to the inside surface of the first front support member 10*a*. The outside surface of the first front support member 10*a* can be at a first angle 56*a*. The first angle 56*a* can control the angle at which the first back support member 12*a* pivots.

The outside of the first back support member 12*a* can have a first notch 50*a*, which allows the first connector 47*a* to pass through the first front support member 10*a* and the first back support member 12*a* perpendicular to the outside surface of the first support member 10*a*.

The first nut 46*a* can engage a portion of the first connector 47*a* and the inside surface of the first front support member 10*a*, and the first washer 48*a* can sit within the first notch 50*a* and engage at portion of the first connector 47*a*. Accordingly, the first nut 46*a* and the first washer 48*a* can hold the first connector 47*a* in place.

FIG. 2B depicts the second pivot means 49*b* according to one or more embodiments.

The second connector 47*b* can pass through the second back support member 12*b*, such that the second connector 47*b* is perpendicular to the inside surface of the second front support member 10*b*. The outside surface of the second front support member 10*b* can be at a second angle 56*b*. The second angle 56*b* can control the angle at which the second back support member 12*b* pivots. The angles 56*a* and 56*b* can have the same value.

The outside of the second back support member 12*b* can have a second notch 50*b*, which allows the second connector 47*b* to pass through the second front support member 10*b* and the second back support member 12*b* perpendicular to the outside surface of the second front support member 10*b*.

The second nut 46*b* can engage a portion of the second connector 47*b* and the inside surface of the second front support member 10*b*, and the second washer 48*b* can sit within the second notch 50*b* and engage at portion of the second connector 47*b*. Accordingly, the second nut 46*b* and the second washer 48*b* can hold the second connector 47*b* in place.

Figure 3A:
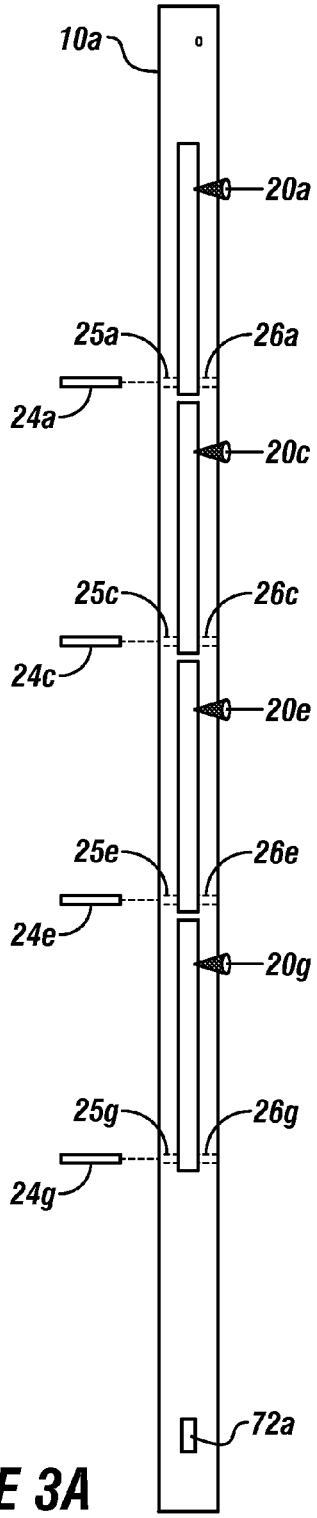
FIG. 3A depicts a detailed view of the first front support member according to one or more embodiments.

FIG. 3A depicts a detailed view of the first front support member 10*a* according to one or more embodiments.

The first front support member 10*a* can include the grooves 20*a*, 20*c*, 20*e*, and 20*g*. The grooves 20*a*, 20*c*, 20*e*, and 20*g* can have front fastener holes 26*a*, 26*c*, 26*e*, and 26*g*. The grooves 20*a*, 20*c*, 20*e*, and 20*g* can also have back fastener holes 25*a*, 25*c*, 25*e*, and 25*g*. A fastener, such as fasteners 24*a*, 24*c*, 24*e*, and 24*g*, can be located through paired front fastener holes and back fastener holes to secure a portion of the rungs (not shown in this Figure), within an associated groove.

The first front support member 10*a* can have a first front support member inner side magnets 72*a* located on a portion thereof. For example, the first front support member inner side magnets 72*a* can be located on an inner side of the first front support member 10*a*.

Figure 3B:
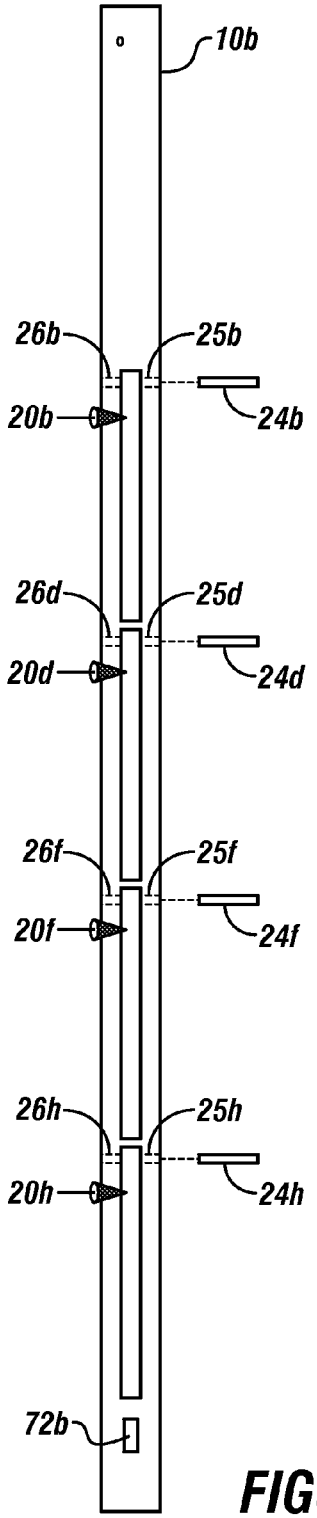
FIG. 3B depicts a detailed view of the second front support member according to one or more embodiments.

FIG. 3B depicts a detailed view of the second front support member 10*b* according to one or more embodiments.

The second front support member 10*b* can include the grooves 20*b*, 20*d*, 20*f*, and 20*h*. The grooves 20*b*, 20*d*, 20*f*, and 20*h* can have front fastener holes 26*b*, 26*d*, 26*f*, and 26*h*. The grooves 20*b*, 20*d*, 30*f*, and 20*h* can also have back fastener holes 25*b*, 25*d*, 25*f*, and 25*h*. A fastener, such as fasteners 24*b*, 24*d*, 24*f*, and 24*h*, can be located through paired front fastener holes and back fastener holes to secure a portion of the rungs (not shown in this Figure), within an associated groove.

The second front support member 10*b* can have a second front support member inner side magnets 72*b* located on a portion thereof. For, example, the second front support member inner side magnets 72*b* can be located on an inner side of the second front support member 10*b*.

Figure 4:
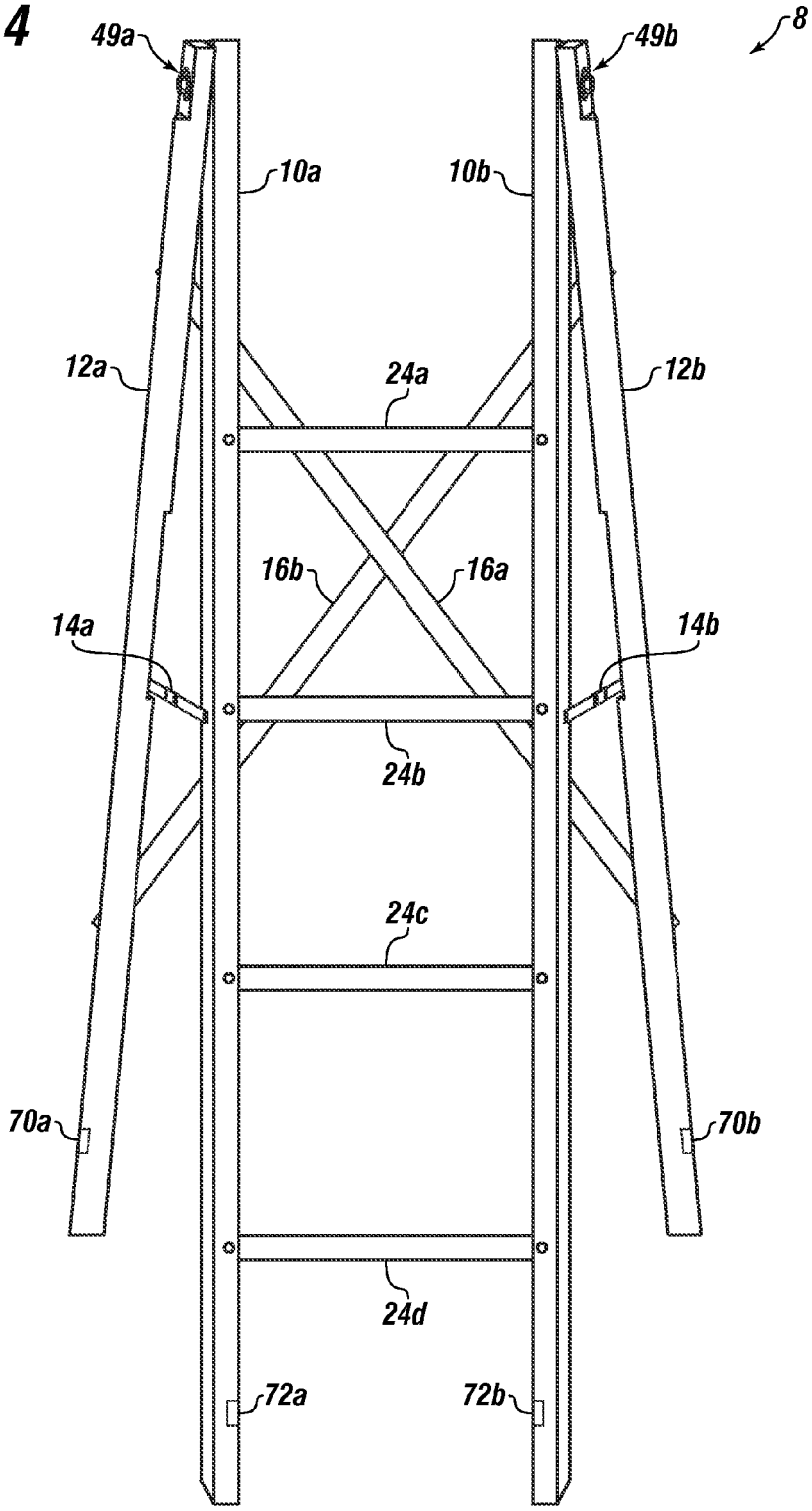
FIG. 4 depicts an assembled view of the folding ladder of FIG. 1 in a deployed configuration according to one or more embodiments.

FIG. 4 depicts an assembled view of the folding ladder of FIG. 1 in a deployed configuration according to one or more embodiments. For clarity, certain previously described parts are not called out. The folding ladder 8 is in a deployed position.

The back support members 12*a* and 12*b* are pivoted away from the front support members 10*a* and 10*b*. The pivot means 49*a* and 49*b* are connecting the front support members 10*a* and 10*b* with the back support members 12*a* and 12*b*.

The locking spreader bars 14*a* and 14*b* are maintaining the position of the front support members 10*a* and 10*b* relative to the back support members 12*a* and 12*b*.

The pivotable cross braces 16*a* and 16*b* are connected to the back support members 12*a* and 12*b* providing strength to the back support members 12*a* and 12*b*.

The rungs 24*a*, 24*b*, 24*c*, and 24*d* are secured between the first front support member 10*a* and the second front support member 10*b*, and are in an unfolded configuration.

The first back support member 12*a* can include a back support member outer side magnets 70*a*, the second back support member 12*b* can include a second back support member outer side magnets 70*b*. The first back support magnet 70*a* can be configured to magnetically interact with the first front support member inner side magnets 72*a*, and the second back support member outer side magnets 70*b* can be configured to magnetically interact with the second front support member inner side magnets 72*b*.

FIG. 5A depicts an assembled view of the folding ladder of FIG. 1 in a folded configuration according to one or more embodiments. For clarity, certain previously described parts are not called out. FIG. 5B depicts a detailed view of a portion of the folding ladder of FIG. 1 in a folded configuration according to one or more embodiments.

The folding ladder 8 is in a folded position. The first front support members 10*a* can be in a flush engagement with the first back support member 12*a*. The second front support member 10*b* and the second back support member 12*b* can also be in a flush arrangement.

Rung 24*a* can be at least partially located within the grooves 20*a* and 20*b*. The other rungs can similarly rest within their associated grooves.

Figure 6A:
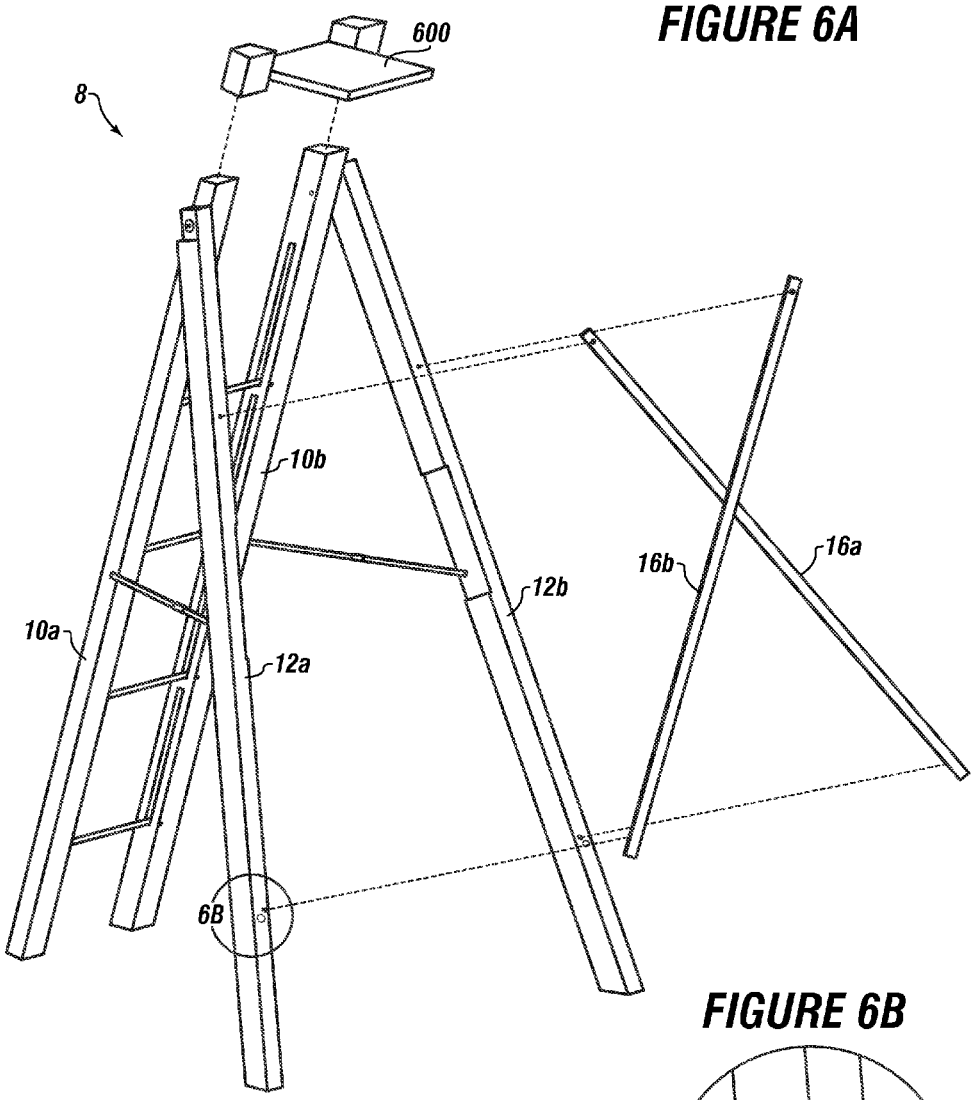
FIG. 6A shows a side view of the folding ladder according to one or more embodiments.
Figure 6B:
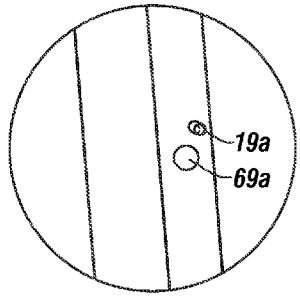
FIG. 6B depicts a detailed view of a portion of the folding ladder according to one or more embodiments.

FIG. 6A shows a side view of the folding ladder 8. FIG. 6B depicts a detailed view of a portion of the folding ladder. For clarity, certain previously described parts are not called out.

The pivotable cross braces 16*a* and 16*b* can have one or more first cavities (not shown in this Figure). The cavities can be configured to engage locking pins on the back support members 12*a* and 12*b*, such as locking pin 19*a*. The locking pins can be domed on top.

The brace support magnets in the pivotable cross braces 16*a* and 16*b* can be magnetically attracted to positioning magnets on the back side of the back support members 12*a* and 12*b*, such as magnet 69*a*.

In one more embodiments, the front support members 10*a* and 10*b* can extend past the back support members 12*a* and 12*b* when the folding ladder 8 is in a deployed configuration. Accordingly, a lip can be formed for receiving a tray 600.

While these embodiments have been described with emphasis on the embodiments, it should be understood that within the scope of the appended claims, the embodiments might be practiced other than as specifically described herein.

What is claimed is:

1. A folding ladder comprising:

a. a pair of front support members, wherein each front support member has a top end and a bottom end, wherein the front support members are parallel to one another, and wherein each front support member comprises:
   (i) an inside side;
   (ii) a front side connected at a 90 degree angle to the inside side;
   (iii) an outer side extending at from a 95 degree angle to a 120 degree angle from the front side;
   (iv) a back side connected at a 90 degree angle to the inside side; and
   (v) a plurality of grooves on the inside side of the pair of front support members, wherein each groove comprises:
      (a) a groove bottom end; and
      (b) a groove top end formed in each inside side, wherein each groove bottom end of the first front support member is horizontally aligned with each groove top end of the second front support member;

b. a plurality of front fastener holes disposed in the front side aligned with a plurality of back fastener holes in the back side;

c. a pair of non-parallel back support members, wherein each back support member has a back top end and a back bottom end, and wherein the pair of non-parallel back support members are spaced apart in an increasing distance along the length of the back support member, and wherein each back support member comprises:
   (i) a back support member front side;
   (ii) a back support member inside with a channel;
   (iii) a back support member outer side; and
   (iv) a back support member back side, wherein the back support member inside forms a flush engagement with the front support member outer side;

d. a plurality of pivot means, wherein each pivot means is disposed centrally through each back top end and extending from each back top end to an off center position in each front support top end;

e. a plurality of rungs, wherein each rung is rotatably supported between the front support members with a pair of fasteners, with each fastener positioned in a front aligned fastener hole with a back aligned fastener hole, and wherein each rung pivotably connects the groove bottom end of one of the first support member grooves with a groove top of each of the second front support member grooves, and when the folding ladder is in the folded position, the rungs fold into the sequentially positioned grooves of at least one of the front support members;

f. a pair of locking spreader bars, wherein each locking spreader bar foldably engages a front support member to a back support member;

g. a pair of pivotable cross braces, wherein each pivotable cross brace has a first brace end secured to the back support member outer side proximate to the back top end, and a second brace end secured to the back support member towards the back bottom end, forming an X proximate to a midpoint between the back support members; and h. a plurality of recessed magnets for supporting the pivoting cross braces and for allowing portions of the folding ladder to compactly and securely engage each other.

2. The folding ladder of claim 1, wherein the plurality of recessed magnets comprise:

a. a pair of brace support magnets in the back support back side;

b. a pair of positioning magnets in each second brace end;

c. a pair of back support member outer side magnets; and d. a pair of front support member inner side magnets.

3. The folding ladder of claim 1, further comprising a locking pin on the back support member outer side to position the pair of pivotable cross braces.

4. The folding ladder of claim 1, wherein the front support members have identical lengths, and the back support members have identical lengths.

5. The folding ladder of claim 1, wherein the front support members range in length from 2 feet to 24 feet.

6. The folding ladder of claim 1, further comprising a lip formed in the back top end.

7. The folding ladder of claim 1, wherein each rung has a flattened top side forming a step.

8. The folding ladder of claim 1, wherein, when the folding ladder is in a collapsed position, each of the plurality of rungs, which are each pivotally connected to a grove on each front support member, lie within both of the grooves to which each of the plurality of rungs is pivotally connected.

* * * * *